United States Patent [19]

Berry et al.

[11] 4,083,540

[45] Apr. 11, 1978

[54] GAS AND OXYGEN STEEL MAKING LANCE

[75] Inventors: William W. Berry, Pittsburgh; Leo L. Meinert, Beaver; Nicholas M. Rymarchyk, Pittsburgh, all of Pa.

[73] Assignee: Pullman Berry Company, Harmony, Pa.

[21] Appl. No.: 795,244

[22] Filed: May 9, 1977

[51] Int. Cl.[2] ..... C21C 5/32

[52] U.S. Cl. ..... 266/225

[58] Field of Search ..... 266/225, 226; 239/132.3

[56] References Cited

U.S. PATENT DOCUMENTS 3,972,515 8/1976 Mercatoris ..... 266/225

*Primary Examiner*—Gerald A. Dost

*Attorney, Agent, or Firm*—Thomas G. Anderson

[57] ABSTRACT

A gas and oxygen lance includes a top support member with first and second connector assemblies connected together with a quick release arrangement. The connector assemblies both include plates with aligned openings which transmit oxygen, gas, and water from the top support to the nozzle by means of oxygen, gas, and water pipes. The lance includes a sleeve assembly connected to one of the connector assemblies which is readily replaceable and which are connected in relative sealing and sliding relation to the oxygen and gas pipes. O-ring seals are provided to prevent leakage and a venting system safeguards the assembly in the event of leakage.

16 Claims, 6 Drawing Figures

GAS AND OXYGEN STEEL MAKING LANCE

CROSS-REFERENCES TO RELATED PATENT APPLICATION

The instant patent application is related to the following five co-pending patent applications which were filed in the Patent Office on the same date as the instant application:

Ser. No. 795,243, filed May 9, 1977
Ser. No. 795,245, filed May 9, 1977
Ser. No. 795,247, filed May 9, 1977
Ser. No. 795,248, filed May 9, 1977
Ser. No. 795,246, filed May 9, 1977.

BACKGROUND OF THE INVENTION

1. Field of the Invention

The present invention relates to oxygen gas lances which are used in a steel making process which is conducted in a B.O.F. furnace vessel.

Specifically the invention relates to a quick disconnect lance arrangement.

2. Description of the Prior Art

Patents of the prior art include U.S. Pat. No. 3,620,455 Nov. 16, 1971; 3,827,632 Aug. 6, 1974; 3,912,244 Oct. 14, 1975; RE: 28,769 Apr. 13, 1976 and 3,972,515 Aug. 3, 1976. The present invention is an improvement over these patents.

SUMMARY OF THE INVENTION

The present lance invention is of the type which is easily and quickly disconnected from a top support or head members carried by a lance carriage adjacent to a B.O.F. vessel. The top head or support member is provided with a central oxygen pipe, a gas pipe, and water inlet and outlet pipes which are connected to a suitable supply source. The pipes also are connected to openings in a first connector plate assembly which is connected to a second connector plate assembly having registering openings. The second connector plate assembly includes an easily removable sleeve which is spaced around the oxygen pipe and has a slip fit (or joint) connection with upper and lower telescoping oxygen pipes.

A second sleeve integral with the first sleeve is radially spaced therefrom and has a slip fit connection with the upper end portion of a lower water pipe. The connector plates include O rings between engaging flat surfaces of the plate between the registering openings to provide positive sealing against the entrance of oxygen in the water and vice versa. One of the sleeves adjacent the slip joint connection of the upper and lower oxygen pipes includes a chamber which in the event of leakage communicates with a vent passage which extends through a sleeve plate outwardly for venting to the atmosphere.

DESCRIPTION OF PREFERRED EMBODYMENT

Figure 1:
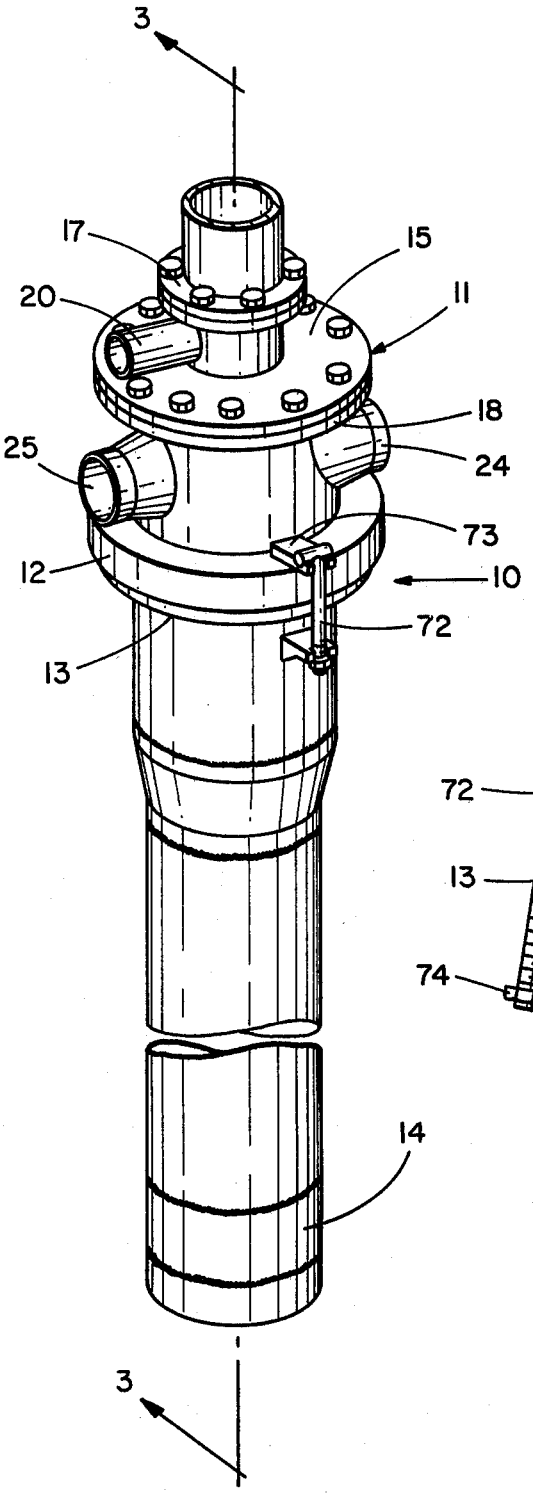
FIG. 1 is a perspective view of a lance arrangement.
Figure 2:
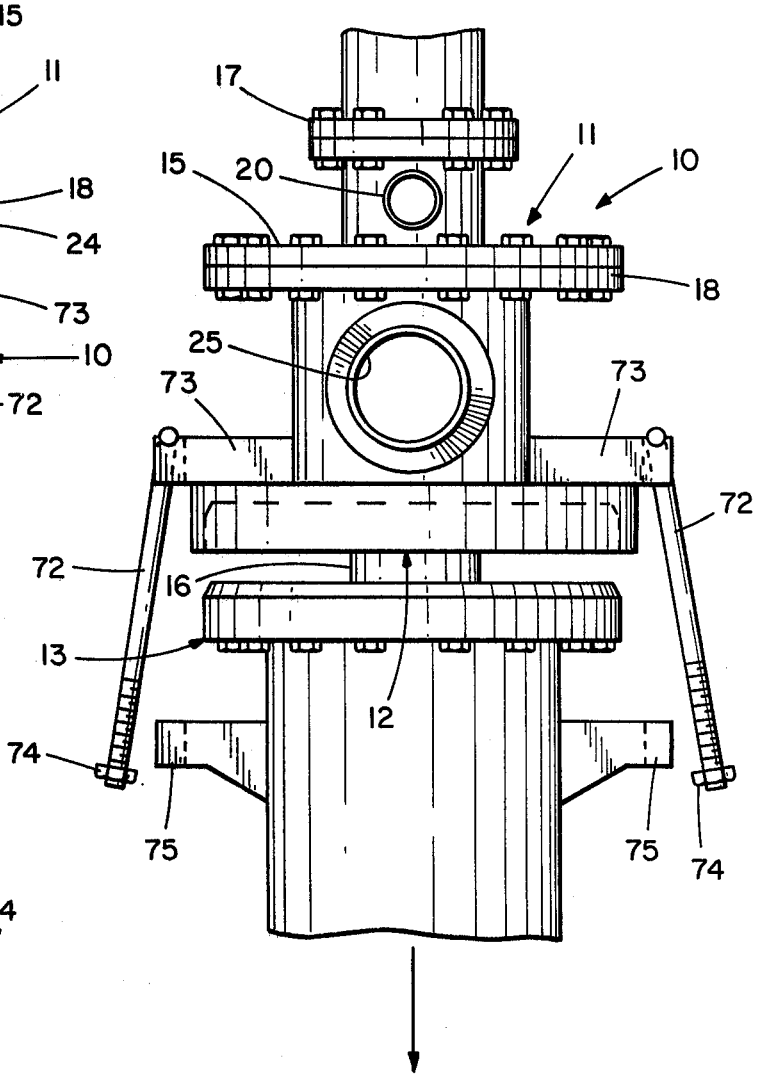
FIG. 2 is an enlarged elevational view of the upper portion of the lance of FIG. 1.
Figure 3:
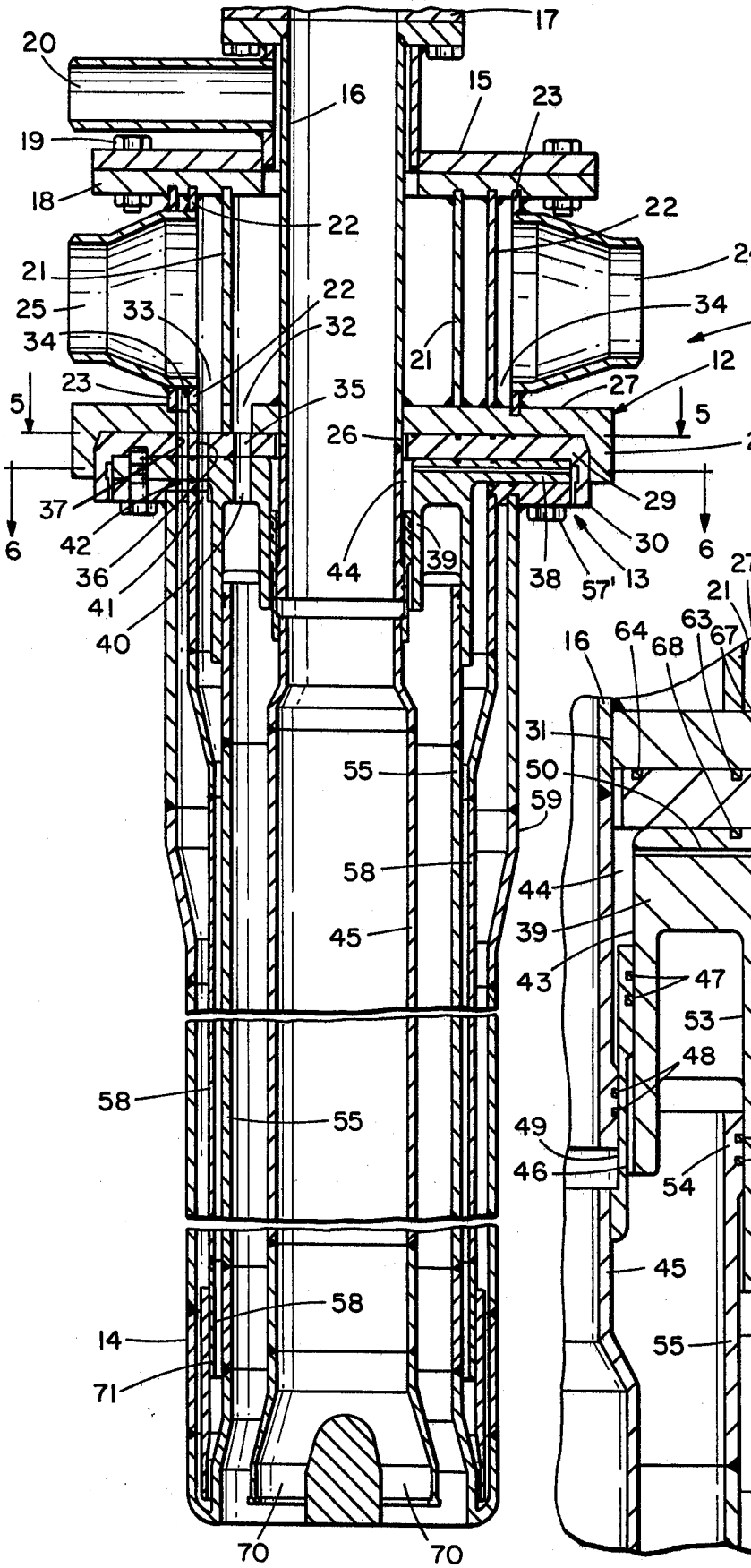
FIG. 3 is a cross-sectional view taken along the line 3—3 of FIG. 1.
Figure 4:
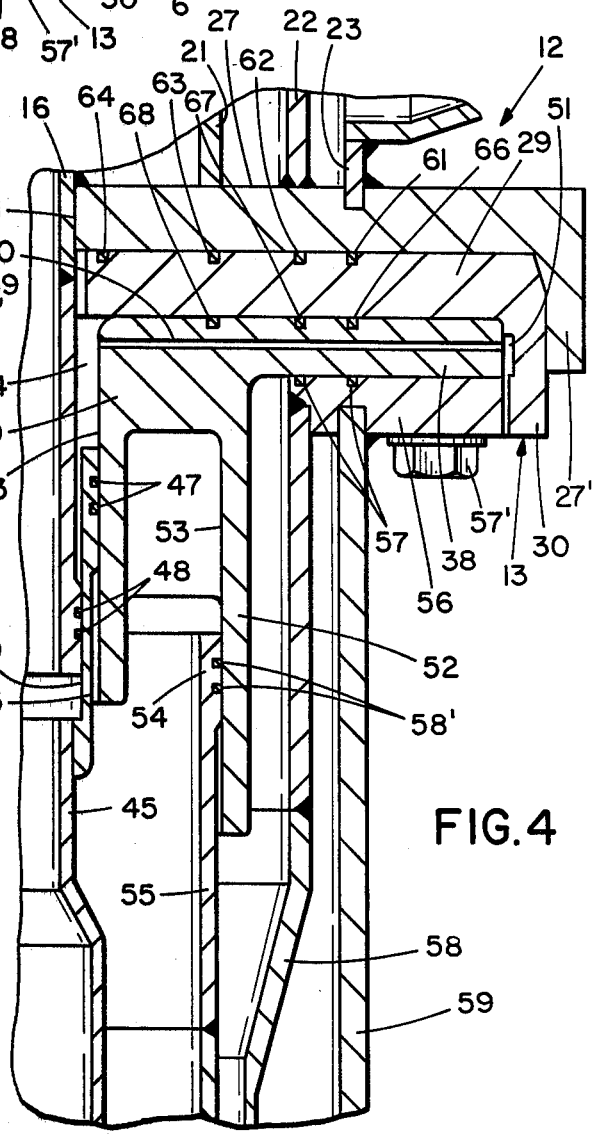
FIG. 4 is a cross-sectional view, enlarged and in detail showing the connection of a pair of connector assemblies.

A lance 10 comprises a top support or head member 11, first and second connector assemblies 12 and 13, and a lance nozzle 14.

The head or support member 11 comprises a top plate 15 which supports the upper end of a first central oxygen pipe 16 communicating with an oxygen supply pipe connection 17. A connector plate 18 is connected to the plate 15 by means of bolts 19. A gas inlet connection 20 communicates with a second gas pipe 21 concentric with oxygen pipe 16. A third water inlet pipe 22 is concentric with the second pipe and a fourth water outlet pipe 23 concentric with pipe 22, is in communication with a water outlet connection 24. A water inlet connection 25 provides water to the third pipe 22.

The first oxygen pipe 16 projects through an opening 26 provided in a plate 27 of the first connector plate assembly 12. The plate 27 includes an outer perpheral downwardly projecting flange 27'. The second, third, and fourth pipes 21, 22, and 23 are connected at their lower ends to the plate 27 and communicates with first gas, water inlet, and water outlet openings respectively 32, 33, and 34.

The second connector assembly 13 comprises a flat plate 29 having a peripheral downwardly projecting flange 30. The first oxygen pipe 16 projects through a central opening 31. The plate 29 includes a second gas opening 35, a water inlet opening 36, and water outlet opening 37 communicating with the first openings of plate 27. The second connector assembly includes a third plate of flange portion 38 which is connected to a sleeve 39. The third plate 38 includes three openings, respectively a gas opening 40, water inlet opening 41 and water outlet opening 42. All of the gas openings, water inlet openings and outlet openings therefore are in communication in the connected assembly of the first and second connector plates.

The sleeve 39 includes an inner surface 43 spaced from the outer surface of pipe 16 to provide an annular space 44 therebetween.

A fifth oxygen pipe 45 includes an upward piston portion 46 which includes spaced O rings 47 in relative sliding or slip joint engagement with the inner surface 43 of sleeve 39. This telescoping or slip joint connector includes a piston portion on the lower end of pipe 16 which includes O rings 48 in sliding engagement with the inner surface 49 of piston portion 46. The annular space 44 provides at its upper end a chamber communicating with a vent passage 50 extending outwardly horizontally in the flange plate 38 and communicating with the atmosphere through a connected passage 51 in the flange 30.

A second sleeve portion 52 on the sleeve 39 and plate 38 is concentric and spaced outwardly of sleeve 39. The sleeve portion 52 includes an inner surface 53 which is engaged in slip joint relation by means of the upper end 54 of a lower sixth gas pipe 55 projecting downwardly toward the nozzle.

A connector ring 56 disposed below the flange or plate 38 is connected thereto by bolts 57'. A lower seventh water inlet pipe 58 and water outlet pipe 59 is connected to said ring 56. The connector ring 56 includes O rings 57 in engagement with the underneath surface of plate 38.

Figure 5:
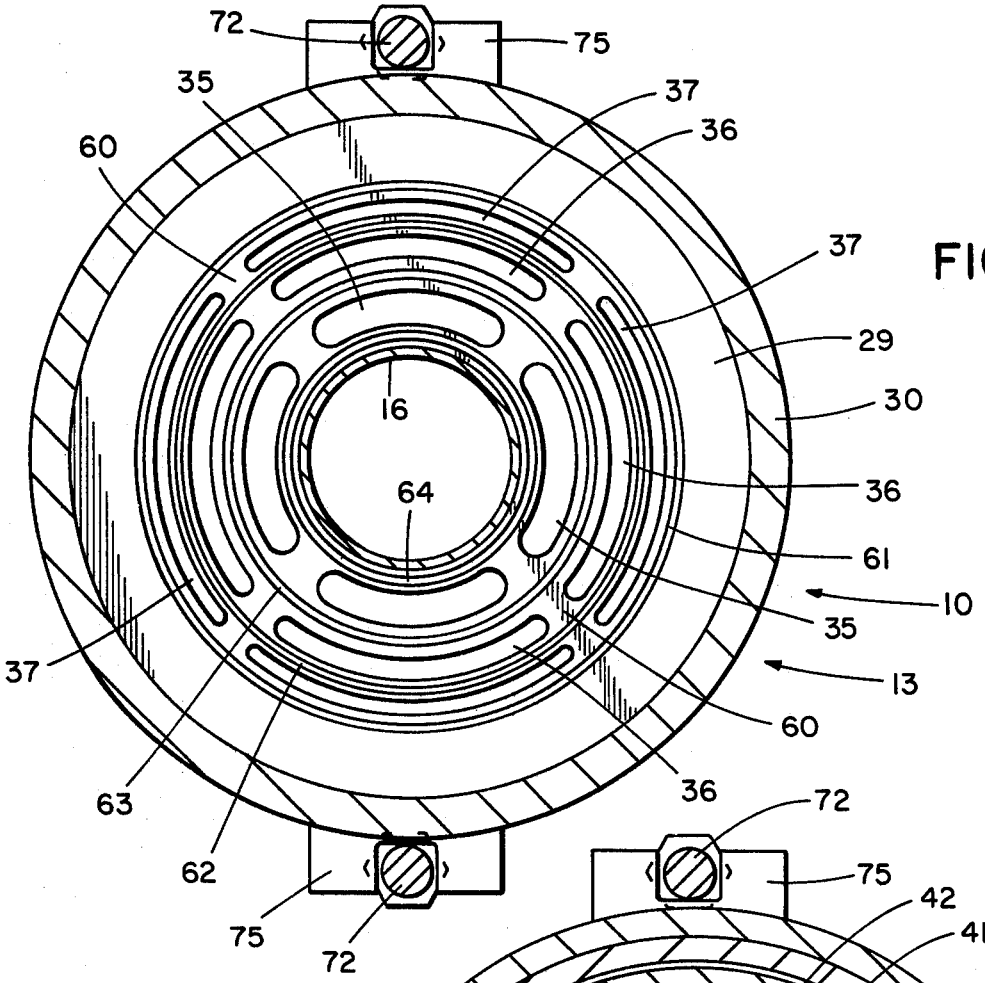
FIG. 5 is a cross-sectional view taken along the line 5—5 of FIG. 3.

The upper end 54 of gas pipe 55 includes O ring seals 58. Referring now to FIG. 5 the openings 35, 36 and 37 are disclosed as individual rows of slots with adjacent ends of each slot in spaced relation relative to the other slots to provide a plurality of webs 60. O rings 61, 62, 63 and 64 are disposed in suitable recess within the surface of plate 29 for sealing one row of arcuate slots from the other.

Figure 6:
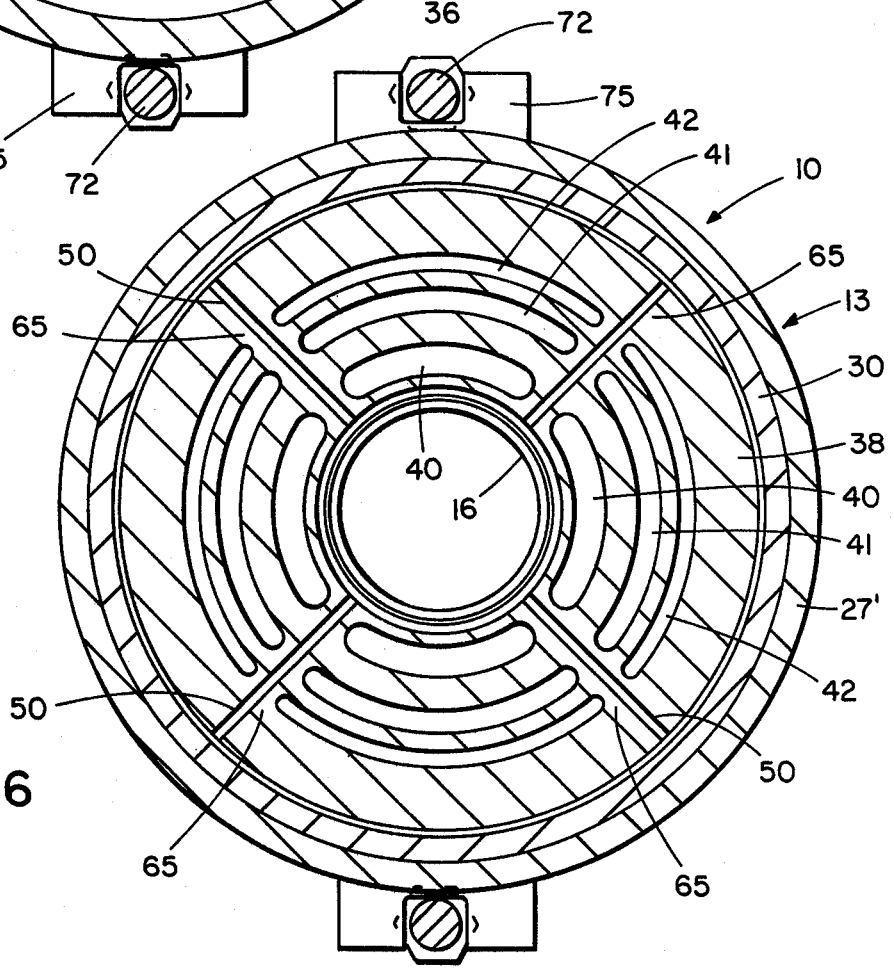
FIG. 6 is a cross-sectional view taken along the line 6—6 of FIG. 3.

Referring now to FIG. 6, the openings 40, 41 and 42 are also of arcuate shape and adjacent opposite ends of each slot are spaced to provide solid portions or webs 65 within which the vent passage 50 extend. The upper surfaces of the sleeve flange or plate portion 38 also includes O rings 66, 67, and 68 which are disposed between adjacent openings 42, 41, and 40 for sealing them against leakage.

The nozzle 14 includes a plurality of orifices 70 at the lower ends of the pipe 45. The gas pipe 55 provides for the flow of gas with the oxygen as desired. The lower end of the water inlet pipe has a slip joint connection with an inlet pipe stub 71 and the water outlet pipe 59 is connected at its lower end to the gas pipe 55.

Quick disconnect of the connector plate assemblies is achieved by the hinged bolts 72 hinged on bases 73 supported on the outer pipe 22. The bolts 72 and nuts 74 are adapted to engage slotted ears 75 mounted on the water outlet pipe 55 to clamp the connector plates in assembly and to quickly disconnect the source.

In the operation oxygen and gas can flow through the oxygen and gas pipes in conventional fasion. The invention is primarily in the connector plate assemblies, the dispostion of the slots and the effective sealing arrangements provided by the O rings. The sleeves and plates of the second connector assembly can easily be dismounted and the sleeve replaced. The O rings can easily be replaced and provides an effective seal to prevent the mixture of oxygen with gas.

In the event of leakage the novel vent passage arrangement and its disposition provides for venting to the atmosphere.

The slip joint connections accomodate the expansion and contraction occasioned by high temperature variations. Thus the present gas and oxygen lance can quickly be disconnected at the site, and the major portion of the lance can be removed for repairs, replacement, transport or other service and again assembled.

We claim:

1. A steel making lance assembly comprising a top support member, said top support member including a first central oxygen pipe, a second gas pipe, and third and fourth water inlet and outlet pipes, all of said pipes being positioned in concentric relation, a first connector plate assembly on said top support member, said first connector plate assembly including upper and lower flat surfaces, having a central opening through which said first oxygen pipe projects, said first connector plate assembly including first gas, water inlet and water outlet openings respectively communicating with said second gas, third and fourth pipes, a second connector plate assembly including second upper and lower flat surfaces, said second connector assembly having a central second opening receiving said first oxygen pipe, said second connector plate assembly including a central sleeve in circumferentially spaced relation relative to said first oxygen pipe to provide an annular space therebetween, a fifth oxygen pipe within said space in telescoping relation with said sleeve and said first oxygen pipe, said second connector plate assembly having a plurality of second gas, water inlet and water outlet openings communicating respectively with said first openings, said second connector plate assembly having a second sleeve concentric with said first sleeve projecting downwardly and having an inner diameter larger than the outer diameter of said first sleeve, a sixth gas pipe in telescoping engagement with said second sleeve, said sixth gas pipe communicating with said first and second gas openings, a seventh water inlet pipe communicating with said first and second water inlet openings, an eighth water outlet pipe communicating with said first and second water outlet openings, a nozzle connected to the lower portions of said fifth, sixth, seventh, and eighth pipes, said nozzle having a chamber and orifice communicating with said gas oxygen pipes, and a water chamber providing for circulation of water between said third, fourth, seventh and eighth pipes, and means quick releasably connecting said first and second connector assemblies in clamping relation and said first and second openings of said connector assemblies being in registering relation.

2. The invention in accordance with claim 1, said annular space providing a vent chamber, and a vent passage in one of said connector plate assemblies communicating with said annular space and providing for communication of said chamber with the atmosphere.

3. The invention in accordance with claim 2, said passage extending horizontally in said second connector plate assembly.

4. The invention in accordance with claim 1, said fifth oxygen pipe including at its upper end portion a piston sleeve in relative contacting and sliding engagement with said lower portion of said first oxygen pipe and said first sleeve.

5. The invention in accordance with claim 4, said piston sleeve including seal means engaging said first sleeve and said first oxygen pipe.

6. The invention in accordance with claim 1, said telescoping connection between said sleeve and said gas pipe including sealing means.

7. The invention in accordance with claim 1, said nozzle including a stub pipe separating said water chamber, the lower end of said one of said seventh and eighth pipes being connected to said stub pipe in telescoping relation.

8. The invention in accordance with claim 2, said first and second openings each comprising three rows of openings spaced radially outwardly from said central opening and oxygen pipe.

9. The invention in accordance with claim 8, said openings of each row being of arcuate shape and having their opposite ends spaced from adjacent opposite ends to provide a plurality of outwardly extending webs circumferentially spaced, and said vent passage being positioned within one of said webs.

10. The invention is accordance with claim 8, said openings of each said row comprising slots having opposite end portions spaced from the end portions of adjacent slots to provide radially extending webs between said said slots, said web each including one of said vent passages, and sealing means between said concentric plate assemblies sealing each row of openings relative to the others.

11. The invention in accordance with claim 2, said sleeve including said connector plate having said second openings, and said vent passage being contained in said connector plate.

12. The invention in accordance with claim 1, said sleeve having a flanged upper surface including third gas, water inlet and water outlet openings communicating said first and second openings.

13. The invention in accordance with claim 12, said second connector plate including O rings between said second openings.

14. The invention in accordance with claim 12, said flanged upper surface including O rings disposed between said third openings.

15. The invention in accordance with claim 12, including a connector ring connecting together said second connector plate and said flanged upper surface of said sleeve.

16. The invention in accordance with claim 15, said connector ring having connected thereto said seventh and eighth pipes, and means removably connecting said connector ring to said flanged or surface of said sleeve.

* * * * *